US006715434B2

(12) United States Patent
Ninomiya

(10) Patent No.: US 6,715,434 B2
(45) Date of Patent: Apr. 6, 2004

(54) EMBROIDERY SEWING MACHINE AND A DRIVE DEVICE THEREOF

(75) Inventor: Masashi Ninomiya, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 199 days.

(21) Appl. No.: 09/916,068

(22) Filed: Jul. 26, 2001

(65) Prior Publication Data

US 2002/0020331 A1 Feb. 21, 2002

(30) Foreign Application Priority Data

Aug. 11, 2000 (JP) ..... 2000-243966

(51) Int. Cl.[7] ..... D05B 77/00; D05C 9/06
(52) U.S. Cl. ..... 112/103; 112/258; D15/75
(58) Field of Search ..... 112/103, 258, 112/102.5, 470.06, 470.09; D15/75

(56) References Cited

U.S. PATENT DOCUMENTS 2,684,041 A * 7/1954 Tice ..... 112/470.09
5,323,722 A * 6/1994 Goto et al. ..... 112/103 X

* cited by examiner

*Primary Examiner*—Peter Nerbun
(74) *Attorney, Agent, or Firm*—Nields & Lemack

(57) ABSTRACT

It is an object of the invention to provide an embroidery sewing machine and a drive device thereof, wherein a cover means is provided to close an opening of a box through which a means for holding an embroidering frame may be protruded out and may be moved for embroidery stitching operation, the holding means being connected to one of a first drive mechanism and a second drive mechanism of the drive device arranged within the box, the first drive mechanism being provided to move the holding means in a first direction and the second drive mechanism being provided to move the holding means in a second direction that is normal to the first direction.

13 Claims, 13 Drawing Sheets

EMBROIDERY SEWING MACHINE AND A DRIVE DEVICE THEREOF

BACKGROUND OF THE INVENTION AND RELATED ART STATEMENT

1. Field of the Invention

The present invention relates to an embroidery sewing machine and a drive device thereof, and more particularly relates to a cover means for closing an opening formed at a box which is provided in connection with the sewing machine, the cover means being operatively connected to the drive device and moved relative to the inner wall of the box while closing the opening which is traversed by a means for holding an embroidering frame during embroidery stitching operation.

2. Prior Art

Generally an embroidery sewing machine has a drive device for moving an embroidering frame in X-Y direction relative to a vertically reciprocating needle so that the stitches may be formed on the work held by the embroidering frame, wherein the drive device is generally arranged in the machine housing or in the box which is removably connected to the sewing machine.

The embroidering frame is removably mounted to a frame holding means which is protruded out of the box through an opening formed thereat so that the frame holding means may be moved in X-Y direction, thereby to move the embroidering frame in X-Y direction accordingly. Thus the embroidery stitches may be formed on the work held by the embroidering frame.

In this connection, the frame holding means is required to move in an area defined by X-direction and Y-direction that is normal to X direction. The opening is, therefore, required to be elongated in one of the X and Y directions in order that the frame holding means may be moved in that direction.

Namely as shown in FIG. 1, a means 4 for driving the embroidering frame 21 is arranged in a base 3 that is a box provided below the lower side of a bed 2 of a machine frame 1. The frame holding means 5 is operatively connected to the frame drive means 4 and the embroidering frame 21 holding a work as extended thereon is removably mounted to the frame holding means 5.

In case the frame holding means 5 is driven in the direction indicated by arrow Y by the drive means 4, the frame holding means 5 is moved in the directions into and out of the opening 6 of the box 3. Therefore, the opening 6 is required to have at least vertical and horizontal dimensions which are sufficient enough to allow movement of the frame holding means 5 having the height and horizontal width of a certain dimension and a weight in case the embroidering frame 21 with a work to be stitched is mounted to the frame holding means 5.

Further the frame holding means 5 is required to move in the X-direction that is normal to the Y-direction. The opening 6 is, therefore, elongated in the same direction with an area of dimensions for allowing a predetermined amount of movement of the frame holding means 5 in the same direction.

Thus, the opening 6 satisfying the requirements for allowing the movement of the frame holding means 5 in the X and Y directions is required to have a considerably large area. The opening 6 is also open for foreign matter which may easily come into the box 3 therethrough to hinder the operation of the drive device 4.

OBJECTS OF THE INVENTION

The invention has been provided to eliminate the defects and disadvantages of the prior art. It is, therefore, a primary object of the invention to provide a cover for closing the opening of the box to prevent the foreign matter from coming into the box in which the drive means is arranged.

It is another object of the invention to provide an opening at the cover through which the frame holding means may be reciprocatingly moved relative to the cover.

It is another object of the invention to provide the cover which is operatively connected to the drive means to be moved thereby along the opening together with the frame holding means while closing the opening.

It is another object of the invention to provide the cover which is flexible so as to be arranged in a relatively narrow space of the box.

It is another object of the invention to provide a guide means for guiding the cover so that the cover may be moved smoothly along the inner wall of the box.

It is still another object of the invention to provide the cover which is longer than the opening of the box so that the opening may be completely covered.

SUMMARY OF THE INVENTION

The invention defined in claim 1 relates to an embroidery sewing machine having an embroidering frame for holding a work to be stitched, a drive device including a first drive mechanism operated in synchronism with vertical reciprocation of a needle to move the embroidering frame in a first direction and a second drive mechanism operated in synchronism with vertical reciprocation of the needle to move the embroidering frame in a second direction normal to the first direction and a box for housing the drive device therein, the embroidery sewing machine comprising a holding means which is operatively connected to one of the first and second drive mechanisms to be driven thereby, the holding means being partly extended out of the box through an opening formed at the box to removably hold the embroidering frame to move the same outside of the box, the opening being of an area sufficient enough to allow the holding means to move a predetermined maximum distance. The embroidery sewing machine further comprises a cover means for closing the opening to resolve a problem without hindering the movement of the holding means in the area of the opening.

The invention defined in claim 2 relates to an embroidery sewing machine having an embroidering frame for holding a work to be stitched, a drive device including a first drive mechanism operated in synchronism with vertical reciprocation of a needle to move the embroidering frame in a first direction and a second drive mechanism operated in synchronism with vertical reciprocation of the needle to move the embroidering frame in a second direction normal to the first direction and a box for housing the drive device therein, the embroidery sewing machine comprising a holding means which is operatively connected to one of the first and second drive mechanisms to be driven thereby, the holding means being partly extended out of the box through an opening formed at the box to removably hold the embroidering frame to move the same outside of the box. The embroidery sewing machine further comprises a cover means for closing the opening while reciprocatingly moving together with the holding means in one direction, thereby to resolve a problem.

Therefore, the cover means includes a cover plate for closing the opening of the box while reciprocatingly moving together with the holding means in one direction, the cover plate having an opening formed thereat for allowing the holding means to reciprocatingly move therethrough into and out of the opening of the box.

The cover plate may be operatively connected to one of the first and second mechanisms of the drive device to be driven thereby or may be connected to another drive device which will move the cover plate in synchronism with the holding means.

Further, the cover plate is longer than the opening of the box to effectively close the opening while the cover plate is reciprocatingly moved along the opening.

It is further preferable to provide for accommodating the long cover plate so that the holding means may be smoothly moved along the opening of the box.

According to a preferred embodiment, the cover plate is moved along the inner wall of the box where the opening is formed. The cover plate is made of an elastic material so that the same may be moved along a corner of the box and so that the same, which is long, may be appropriately arranged within a relatively narrow space of the box. Further, a guide means is provided in the box for securing smooth movement of the cover plate.

The subject matter of the invention may be adapted, besides the box of the sewing machine, to a frame drive device which is separate from the sewing machine and may be removably connected to the sewing machine.

DETAILED DESCRIPTION OF PREFERRED EMBODIMENT

Figure 1:
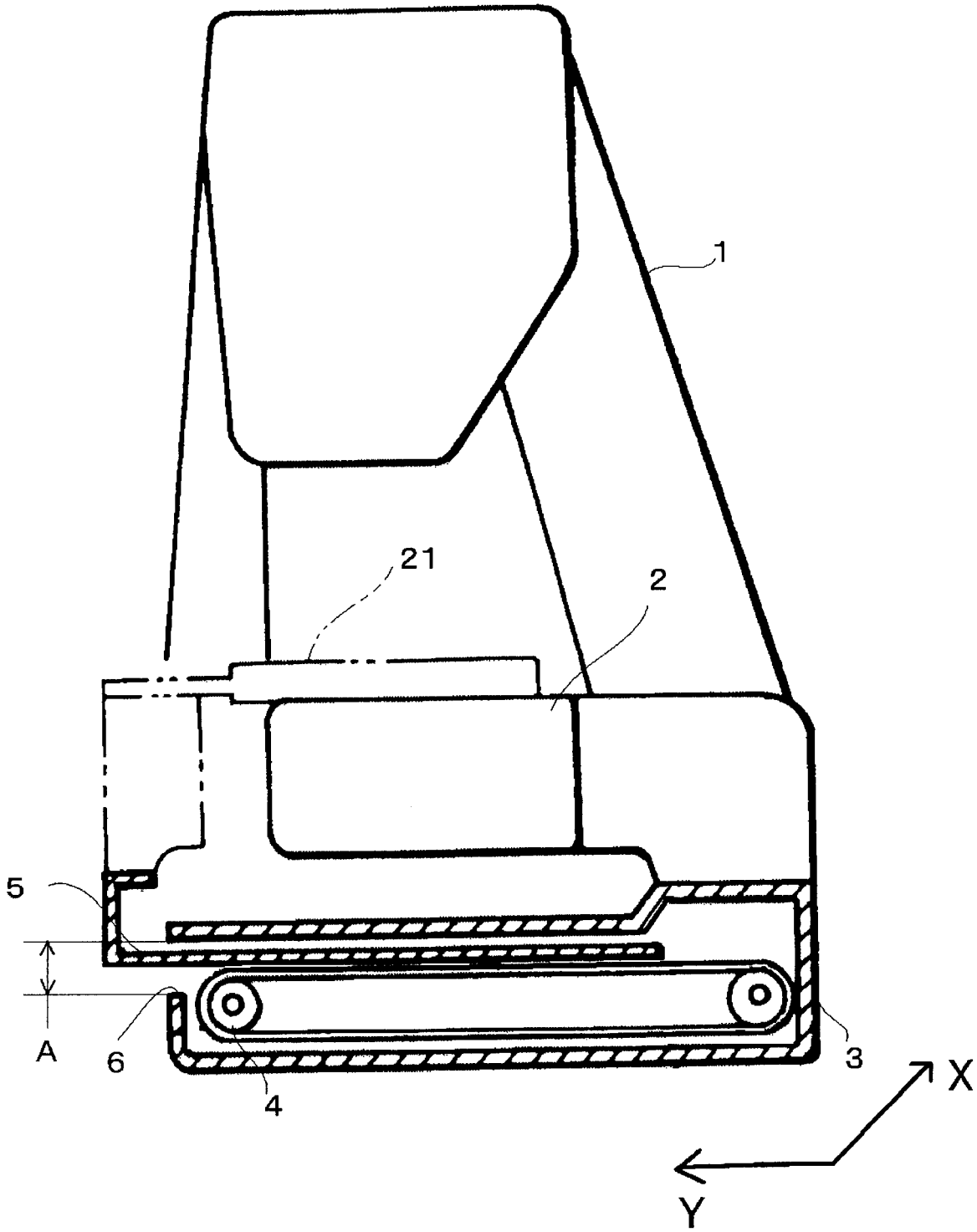
FIG. 1 is a side elevational view of an embroidery sewing machine partly shown in vertical section as one embodiment of the invention.
Figure 2:
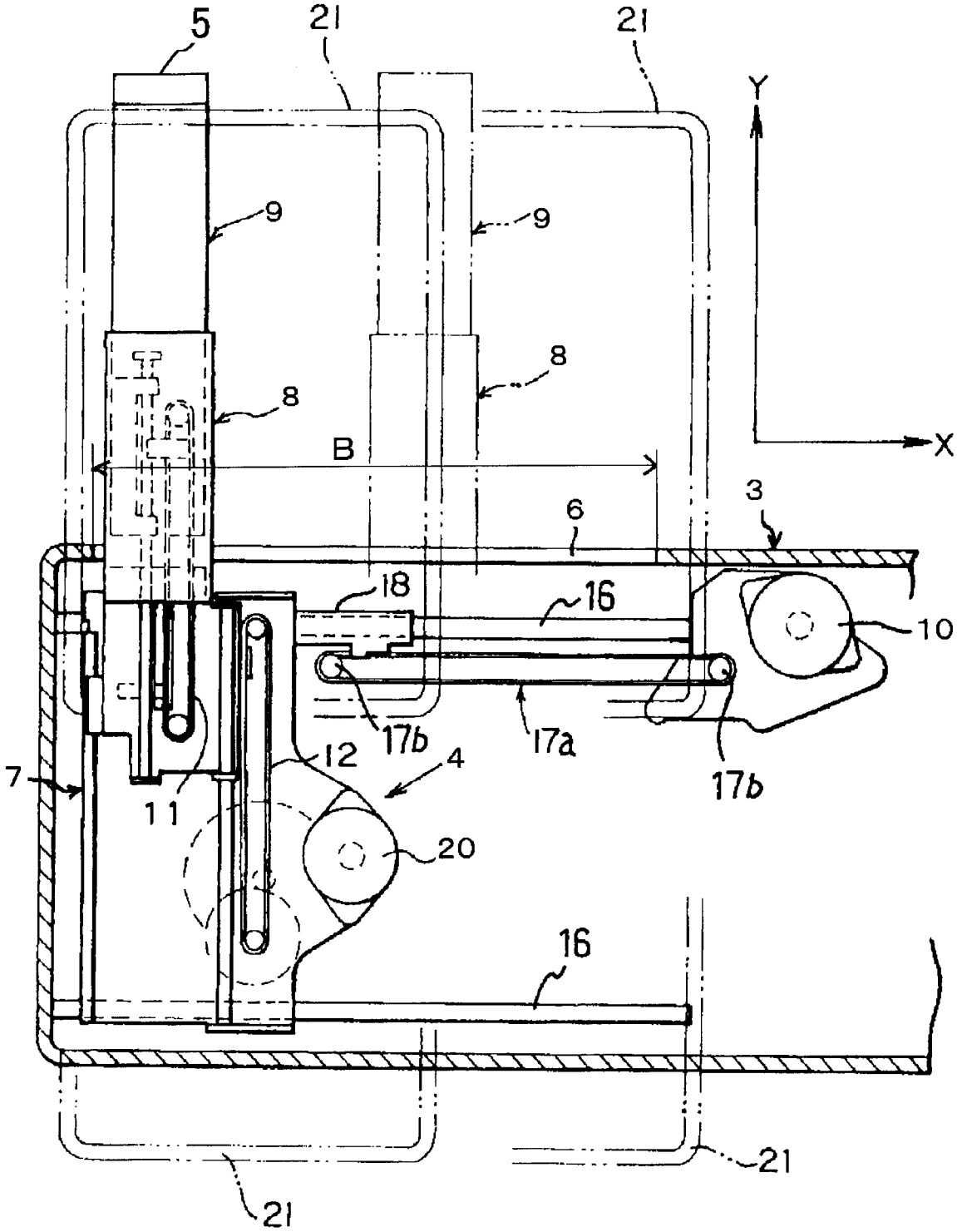
FIG. 2 is a plan elevational view of a base of the sewing machine shown in horizontal section as one embodiment of the invention.

The invention will be described in reference to the embodiment as shown in the attached drawings. FIG. 1 is a side elevational view of the embroidery sewing machine of the invention partly shown in vertical section and FIG. 2 is a plan elevational view of a base of the sewing machine shown in horizontal section to show the inner mechanism. In a machine frame 1, there are provided a drive shaft and a needle bar having a needle attached to the lower end thereof which is vertically reciprocated in association with rotation of the drive shaft. In a bed 2, there is provided a loop taker. Below the bed 2, there is provided a hollow base 3 in which an X-Y drive device 4 is provided. In this connection, the sewing machine has a width in X-direction and a depth in Y-direction.

A mount portion 5, which is a mount means for removably mounting an embroidering frame thereto, is connected to the drive device 4 and is normally extended out of the base 3 through an opening 6 formed thereat so that the mount portion 5 may be moved in the X-Y direction by the drive device 4. Therefore, the hollow base 3 is formed with the opening 6 which is of a vertical width A as shown in FIG. 1 and of a horizontal width B as shown in FIG. 2, the dimension of horizontal width B being decided in consideration of a maximum moving amount of the mount means 5 in the X-direction and the width dimension of the mount portion 5 in the X-direction.

Figure 3:
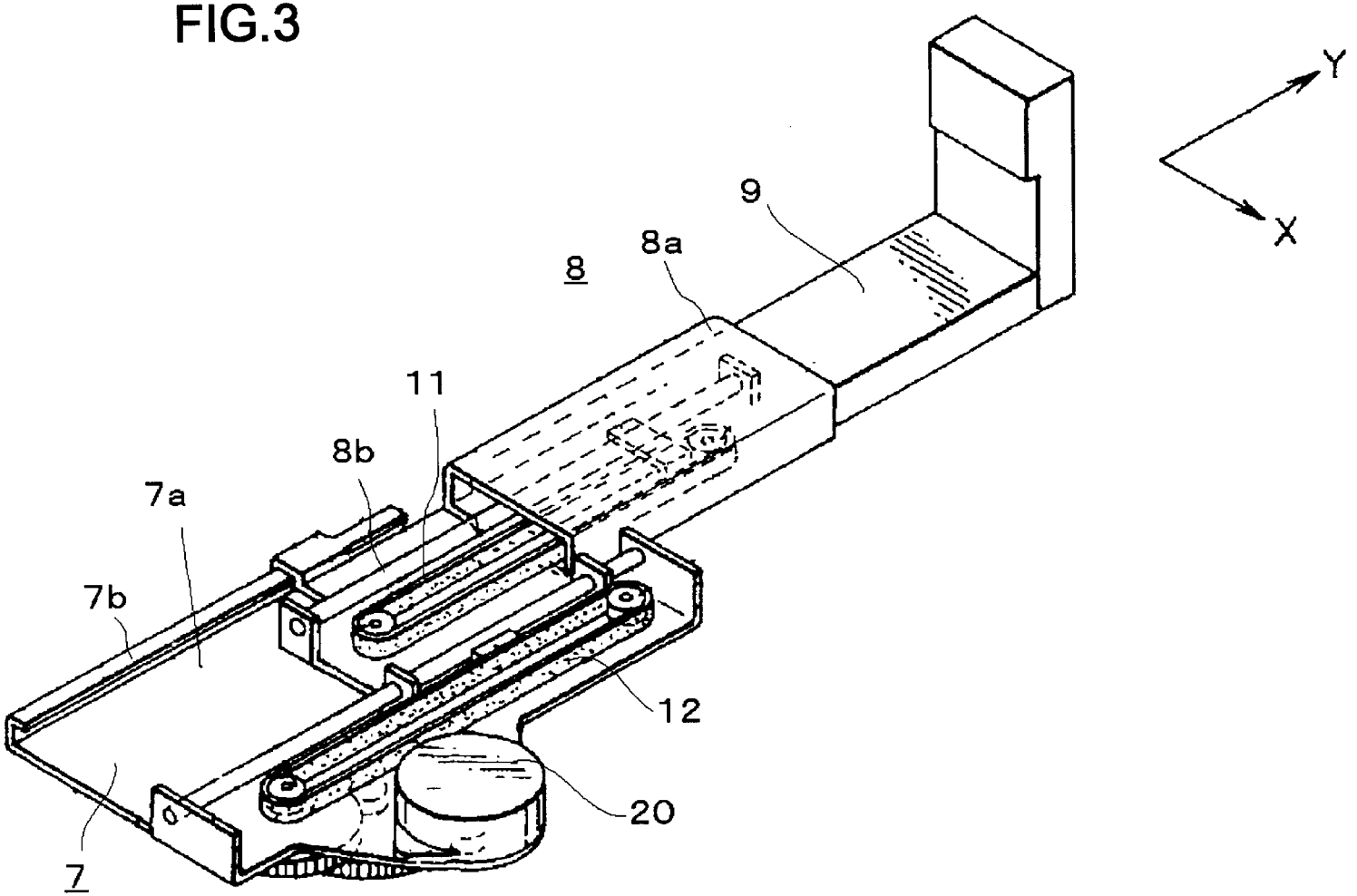
FIG. 3 is a perspective view of a drive device of the sewing machine shown as being enlarged as one embodiment of the invention partly shown in vertical section.

As shown in FIGS. 2 and 3, the drive device 4 includes a base carriage 7, an intermediate carriage 8 and a distal end carriage 9. The base carriage 7 is supported on the base 3 so as to be moved by a drive motor 10 only in the X-direction within the base 3.

As shown in FIG. 3, the base carriage 7 is a flat plate 7*a* having a first guide rail 7*b* extending longitudinally at one side thereof so that the intermediate carriage 8 may be moved on and relative to the base carriage 7 as guided by the guide rail 7*b*.

The intermediate carriage 8 is in a form of a generally a flat rectangular parallelepiped member 8*a* (case-type) having a second guide rail 8*b* and an endless belt 11 provided therein as extending longitudinally thereof. The intermediate carriage 8 is operatively connected to another endless belt 12 so that the same may be moved in the Y-direction relative to the base carriage 7 longitudinally thereof as the endless belt 12 is driven by a drive motor 20. The drive device is described in detail in Japanese patent application 2000-166350 filed by the same applicant of this patent application. The disclosure of the patent application is herein incorporated by reference. Therefore, the further description of the drive device is abbreviated herein.

As the intermediate carriage 8 is moved in the outward direction relative to the base carriage 7, the distal end carriage 9 is moved in the same direction in association with and relative to the intermediate carriage 8 as is extended out of the same. On the other hand, as the intermediate carriage 8 is moved back relative to the base carriage 7 into the base 3, the distal end carriage 9 is moved back in the same direction in association with and relative to the intermediate carriage 8 as is withdrawn into the same. The intermediate carriage 8 and the distal end carriage 9 are arranged in combination to provide the mount portion 5 to which the embroidering frame is removably mounted.

As shown in FIGS. 2 and 3, the X-Y drive device 4 includes an X-direction drive mechanism which is substantially composed of an X-direction guide rail 16, an X-direction drive belt 17*a* which is driven around a pair of oppositely spaced pulleys 17*b*, 17*b*, an a moving member 18 which is mounted on and movable along the X-direction guide rail 16 and is connected to the X-direction drive belt 17*a* and to the base carriage 7, and the aforementioned drive motor 10 which is operatively connected to the drive belt 17*a*.

One of the pulleys 17*b*, 17*b* is operatively connected to the drive motor 10 so as to be rotated thereby so that the drive belt 17*a* may be driven around the pulleys 17*b*, 17*b* and so that the moving member 18 may be moved in the X-direction in association with the drive belt 17*a*, thereby to move the base carriage 7 in the X-direction.

The drive device is described in detail in U.S. patent application Ser. No. 09/604,351, the disclosure of which is herein incorporated by reference. Therefore, the further description of the device is abbreviated therein.

As aforementioned, the base 3 has the opening 6 of horizontal width B formed thereat so that the intermediate carriage 8 and the distal end carriage 9, which are in combination with each other to provide the mount portion 5 which is a holding means, may be extended out of the base 3 through the opening 6 for X-Y movement (FIG. 2).

The opening 6 is formed at the rear side of the base 3 where the intermediate carriage 8, the distal end carriage 9, the mount portion 5 and the embroidering frame 21 mounted to the mount portion 5 are moved in X-Y direction in the area outside of the base 3.

Subsequently a cover means for closing the opening 6 of the base 3 will be described.

Figure 4:
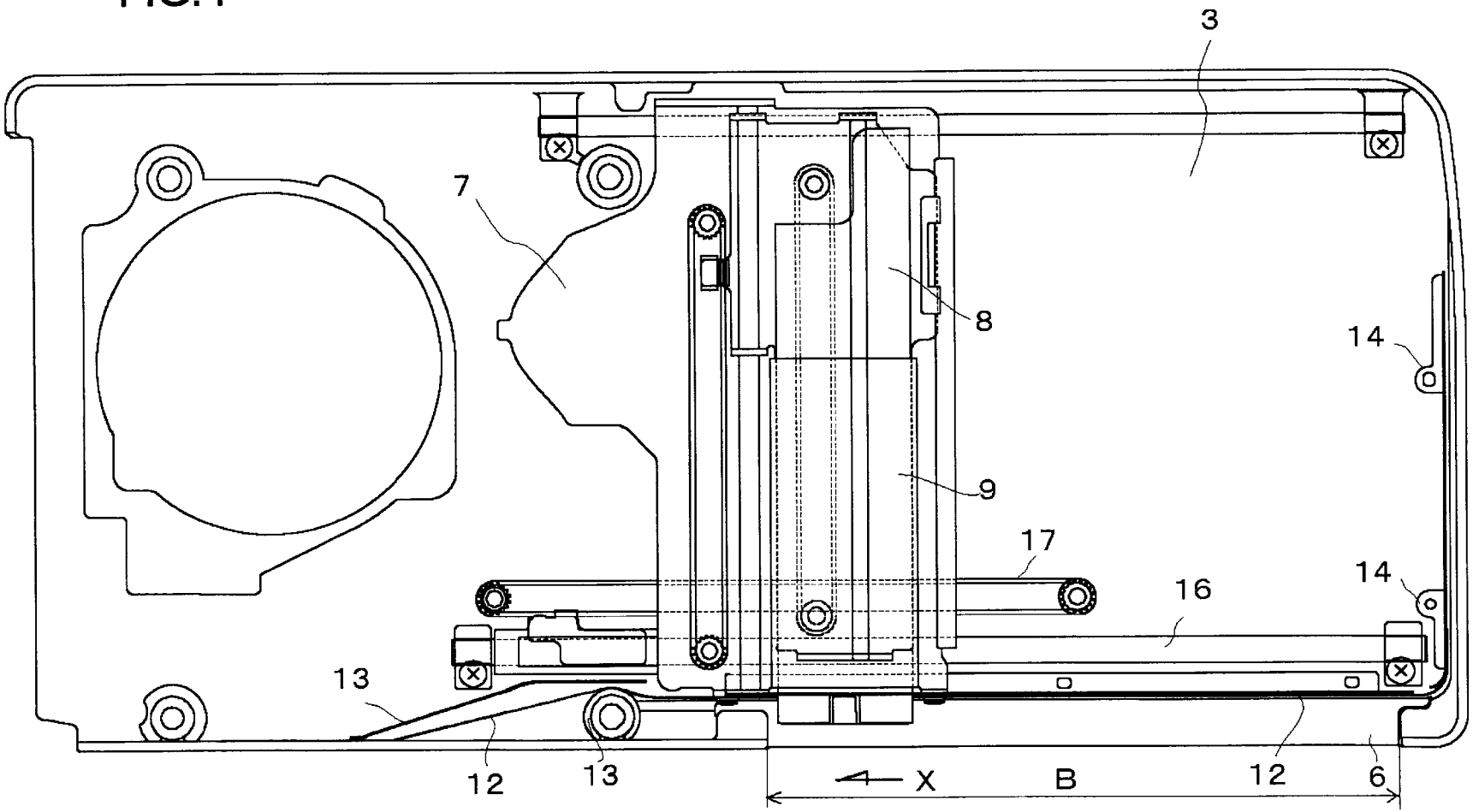
FIG. 4 is a plan elevational view of the base of the sewing machine shown in horizontal section as one embodiment of the invention, wherein a base carriage connected to a cover means is shown as having been moved furthest in the direction as indicated by arrow X.

In FIG. 4, the opening 6 of the base 3 is of a size for allowing the intermediate carriage 8 which partly constitutes the mount means to move relative to the base 3. At an inner side of the opening 6, there is arranged a cover plate 12 which is connected to the base carriage 7 and may be moved together with the base carriage 7 and the intermediate carriage in the X-direction.

Figure 7:
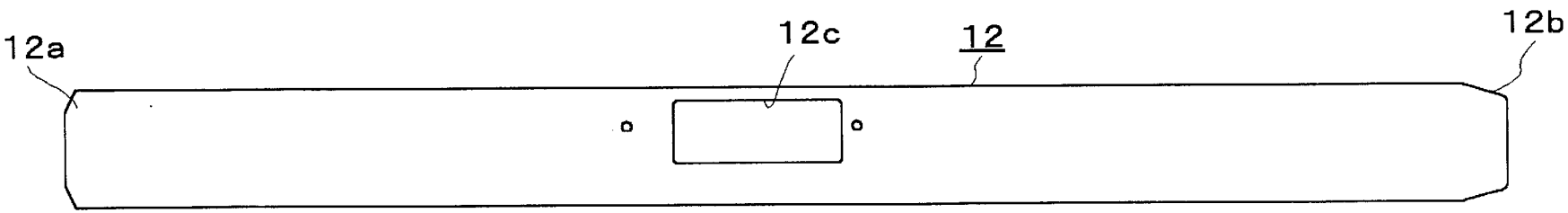
FIG. 7 is an explanatory view of the cover means shown as one embodiment of the invention.

As shown in FIG. 7, the cover plate 12 has a second opening 12*c* through which the intermediate carriage 8 may be reciprocatingly moved in the Y-direction into and out of the box-type base 3. The intermediate carriage 8 may be moved in the X-direction in case the same is extended out of the box-type base 3 as the cover plate 12 is arranged so as to be moved together with the intermediate carriage 8.

With this structure, the opening 6 of the box-type base 3 is always closed by the cover plate 12. The box-type base 3 may be normally prevented from foreign matter which may otherwise come into the base 3 through the opening 6. Preferably the cover plate 12 is a thin and flexible plate with a predetermined degree of elasticity and rigidity. The cover plate 12 may be connected to another drive device, instead of connecting to the base carriage 7, in such a manner as to be moved in synchronism with the intermediate carriage 8.

Figure 8:
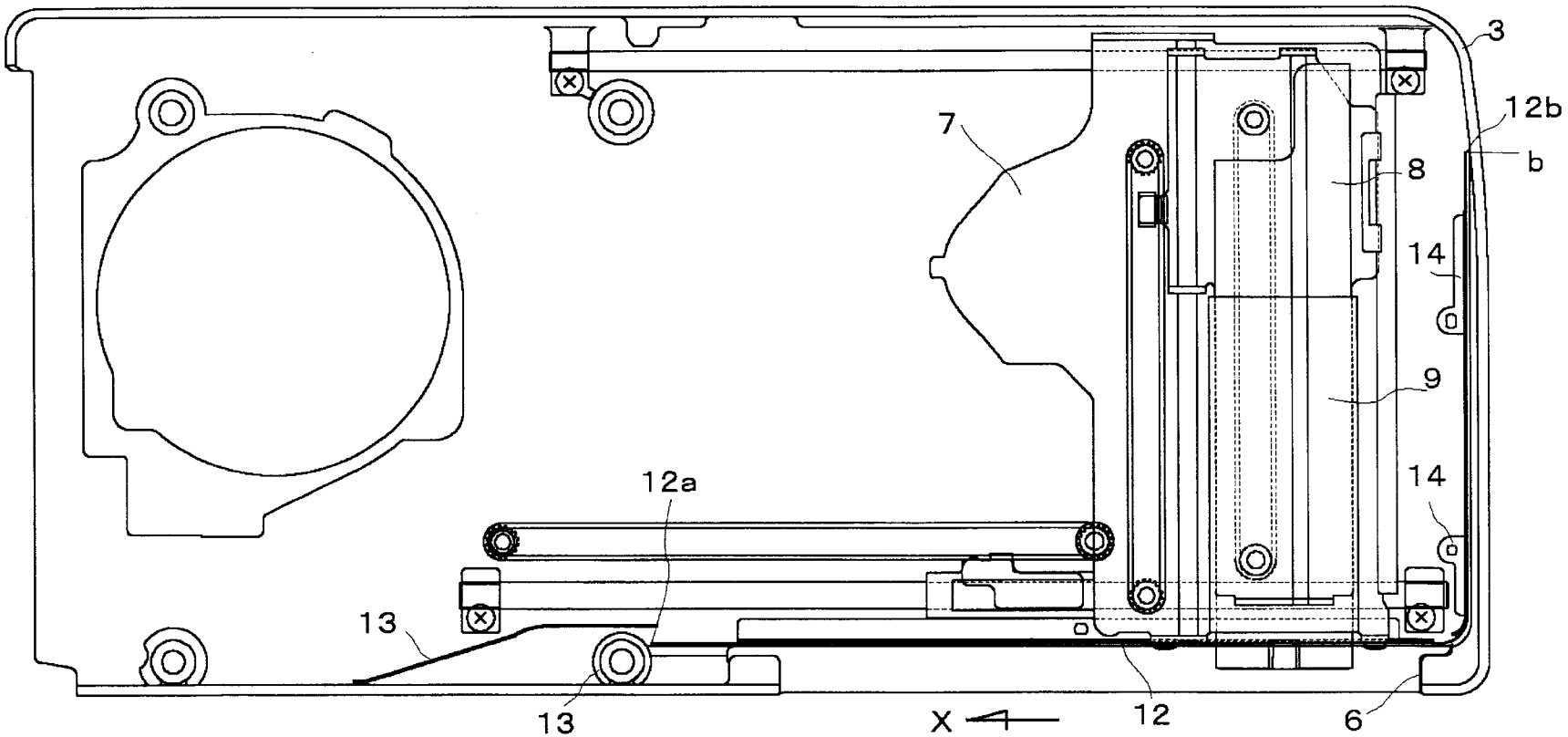
FIG. 8 is a plan elevational view of the base of the sewing machine shown in horizontal section as one embodiment of the invention, wherein the base carriage connected to the cover means is shown as having been moved furthest in the direction opposite to the direction as indicated by arrow X.

The cover plate 12 has a length or more of a total length as defined by a stroke of the base carriage 7 and the intermediate carriage 8 in the X-direction and by the longitudinal width B of the opening 6 that is the length of the opening 6 in the X-direction. Namely, as shown in FIG. 8, the cover plate 12 is of a length extending from one end 12*a* to the other end 12*b*.

The cover plate 12 may be moved along the inner wall surface of the base 3 formed with the opening 6. According to the embodiment, as shown in FIG. 8, the cover plate 12 is partly bent about 90° at the corner of the base 3 which is adjacent to one end of the opening 6. Therefore, the cover plate 12 may be moved along the inner wall surface of the base 3 while the same is bent.

In this way, the elongated cover plate 12 may be appropriately arranged in a limited space of the base 3.

The reference numerals 13, 13 denote the guides respectively for guiding the cover plate 12 while the same is moved along the inner wall of the base 3 in the direction indicated by arrow x. The reference numeral 14, 14 denote the guides for guiding the cover plate 12 while the same is moved along the inner wall of the base 3 in the opposite direction.

Subsequently, operation of the cover plate 12 will be described.

Figure 5:
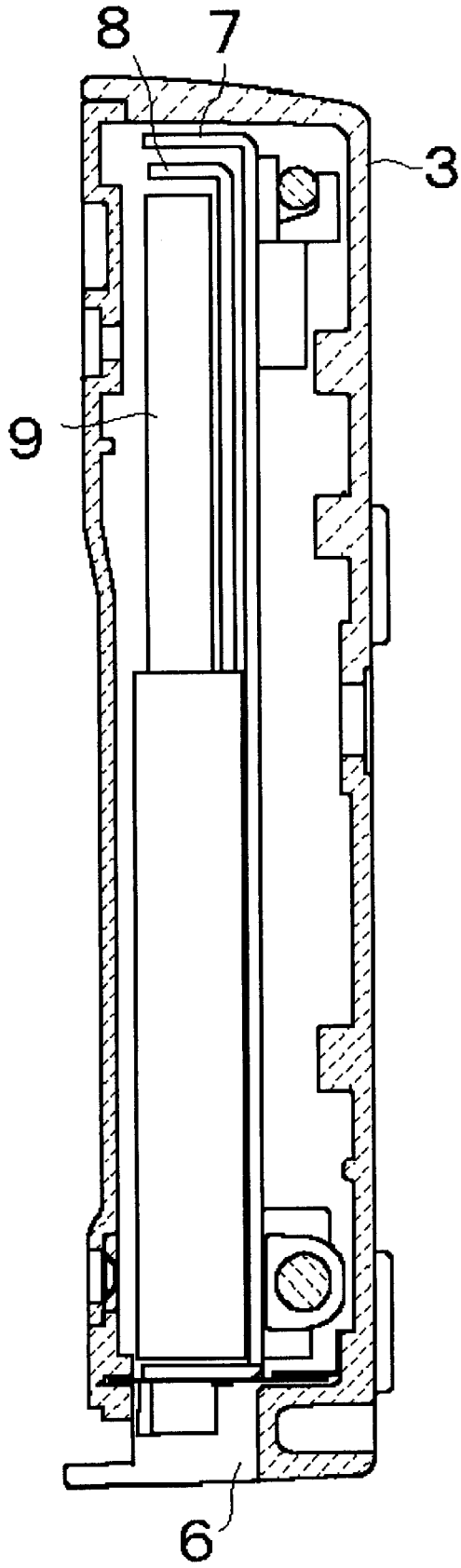
FIG. 5 is a side elevational view of the base of FIG. 4 shown in vertical section.
Figure 6:
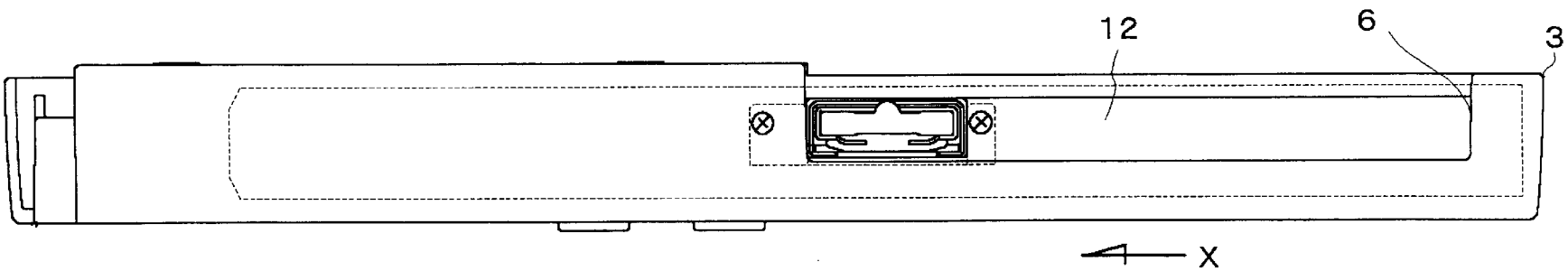
FIG. 6 is a side elevational view of the base of FIG. 4 showing an opening of the base.
Figure 10:
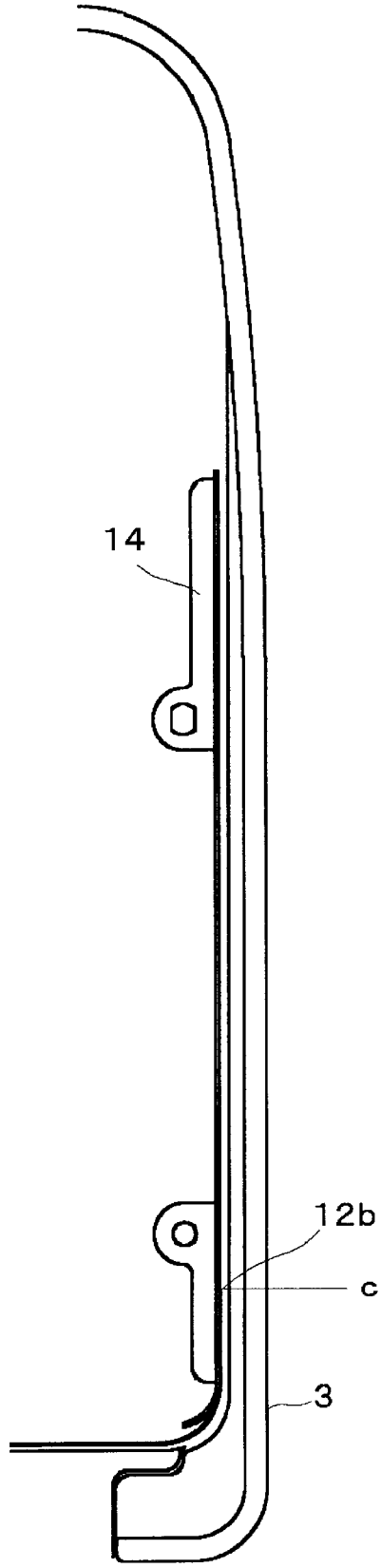
FIG. 10 is an explanatory view of the cover means of FIG. 4, wherein one end of the cover means is shown at a predetermined position.
Figure 11:
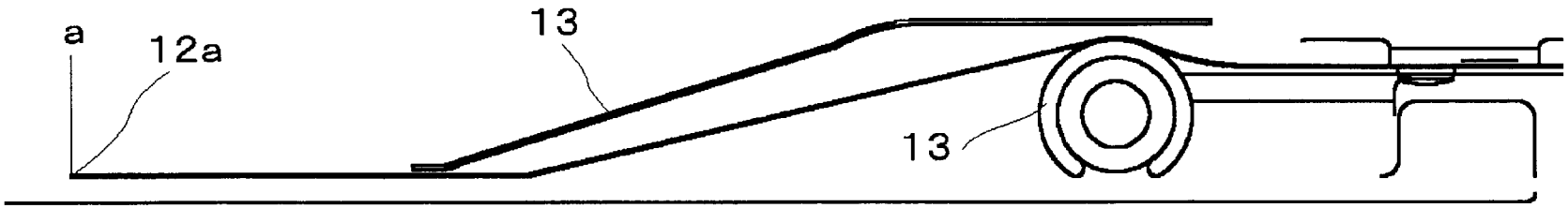
FIG. 11 is an explanatory view of the cover means of FIG. 4, wherein the opposite end of the cover means is shown at a predetermined position.

FIGS. 4, 5 and 6 show that the base carriage 7 has been moved furthest distance in the X direction indicated by arrow x, wherein one end 12*a* of the cover plate 12 is locate at the position "a" while the same is guided by the guides 13, 13 in the direction indicated by arrow x as shown in FIG. 11. In this case, the opposite end 12*b* of the cover plate 12 is located at the position "c" as shown in FIG. 10. With the cover plate 12 being thus positioned, the opening 6 of the base 3 is closed by the cover plate 12.

Figure 9:
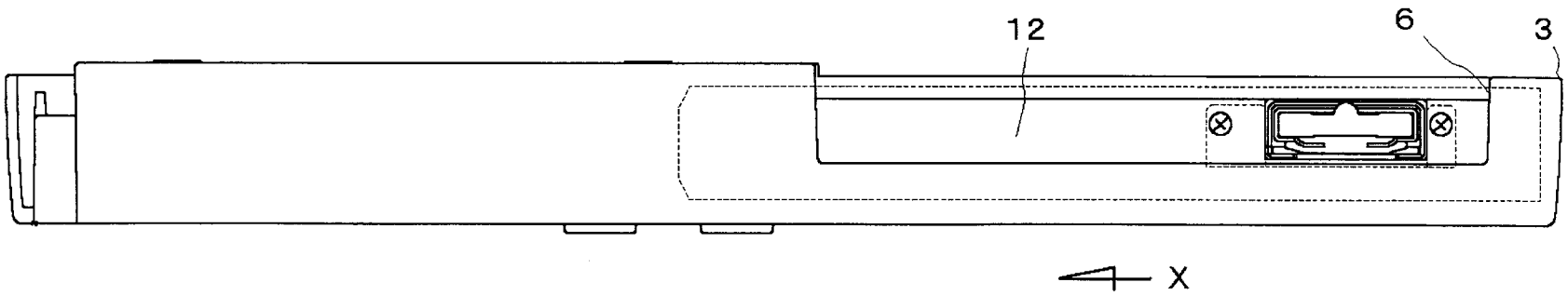
FIG. 9 is an explanatory view of the opening of the base as shown in FIG. 8.
Figure 12:
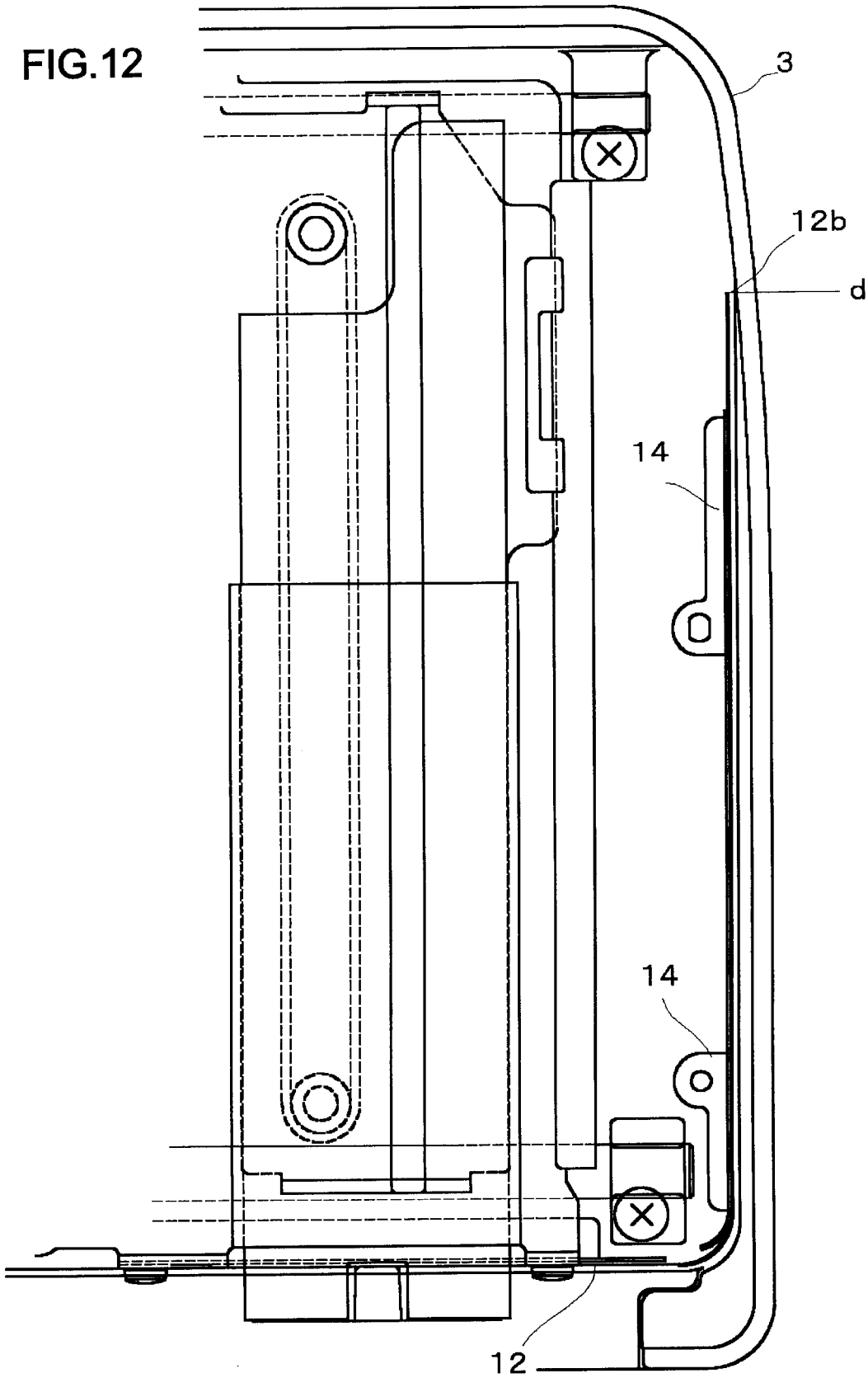
FIG. 12 is an explanatory view of the cover means of FIG. 8, wherein one end of the cover means is shown at a predetermined position.
Figure 13:
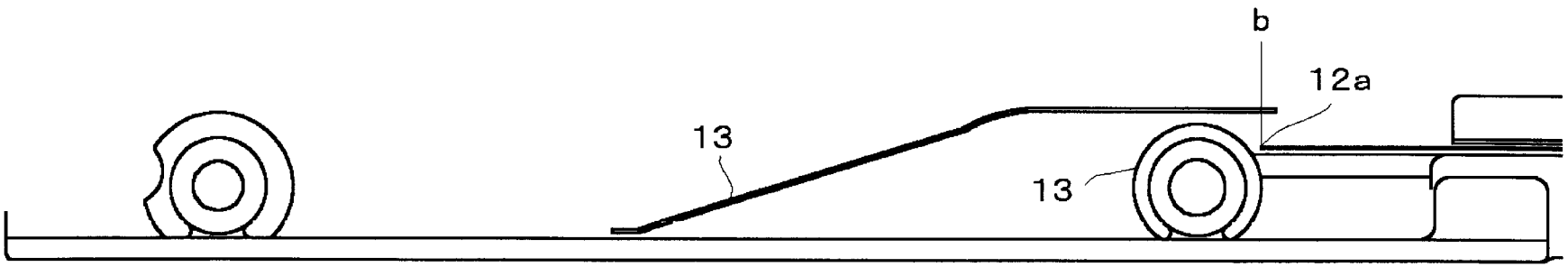
FIG. 13 is an explanatory view of the cover means of FIG. 8, wherein the opposite end of the cover means is shown at a predetermined position.

The condition that the base carriage 7 has been moved furthest distance in the direction opposite to the direction indicated by arrow x is shown in FIGS. 8 and 9, wherein the end 12*a* of the cover plate 12 is located at the position "b" adjacent to one of the guides 13, 13 as shown in FIG. 13 while the opposite end 12*b* of the cover plate 12 is located at the position "d" as is guided by the guides 14, 14 as shown in FIG. 12. In this condition, the opening 6 is closed by the cover plate 12.

Namely, the cover plate 12 will close the opening 6 of the base 3 while the base carriage 7 is moved all through the area that may be traversed thereby. As the intermediate carriage 8, that is the mount means, is moved into and out of the base 3 through the opening 12*c* formed at the cover plate 12, the cover plate 12 will prevent foreign matter from coming into the base 3 through the opening 6 thereof.

As has been described above, the embroidery sewing machine and the drive device thereof of the invention has a means for holding an embroidering frame, the holding means being operatively connected to one of the X- and Y-drive mechanisms of the drive device and protruded out of a box through an opening formed thereat as is extended in one direction with a dimension of area corresponding to the area in which the holding means may move while moving toward and away from the box which is provided to house the drive device, and further has a cover means for closing the opening, the cover means being operatively connected to one of the X- and Y- drive mechanisms of the drive device so as to be moved together with the holding means so that the cover means will not obstruct the movement of the holding means. Therefore, the cover means will prevent the foreign matters from coming into the box to cause trouble of the drive device.

The invention being thus described, it will be obvious that the same may be varied in many ways. Such variations are not to be regarded as regarded as a departure from the spirit and scope of the invention, and all such modifications are intended to be included within the scope of the following claims.

What is claimed:

1. An embroidery sewing machine having an embroidering frame for holding a work to be stitched, a drive device including a first drive mechanism operated in synchronism with vertical reciprocation of a needle to move the embroidering frame in a first direction and a second drive mechanism operated in synchronism with vertical reciprocation of the needle to move the embroidering frame in a second direction normal to the first direction and a box for housing the drive device therein, said embroidery sewing machine comprising:

(a) a means for holding said embroidering frame, the holding means being connected to one of said first and second drive mechanisms to be moved thereby as it is protruded out of the box;

(b) an opening formed at said box with the dimensions defining a predetermined area for allowing the holding means to protrude therethrough and to move for embroidery stitching operation;

(c) a cover means for closing said opening without being in the way of said holding means which is moved along said opening.

2. An embroidery sewing machine having an embroidering frame for holding a work to be stitched, a drive device including a first drive mechanism operated in synchronism with vertical reciprocation of a needle to move the embroidering frame in a first direction and a second drive mechanism operated in synchronism with vertical reciprocation of the needle to move the embroidering frame in a second direction that is normal to the first direction and a box for housing the drive device therein, said embroidery sewing machine comprising:

(a) a means for holding said embroidering frame, the holding means being connected to one of said first and second drive mechanisms to be moved thereby as it is protruded out of the box;

(b) an opening formed at said box with the dimensions defining a predetermined area for allowing the holding means to protrude therethrough and to move for embroidery stitching operation;

(c) a cover means for closing said opening without being in the way of said holding means which is movable along said opening, said cover means being movable in association with movement of said holding means in one of said first and second directions.

3. The embroidery sewing machine as defined in claim 2, wherein said cover means includes a cover plate which is movable in said one of said first and second directions while closing said opening, said cover plate having a second opening formed thereat for allowing said holding means to move therethrough in the other of said first and second directions.

4. The embroidery sewing machine as defined in claim 3, wherein said cover plate is moved by said one of said first and second mechanisms and is moved together with said holding means.

5. The embroidery sewing machine as defined in claim 3, further comprising a means for moving said cover plate in synchronism with movement of said holding means.

6. The embroidery sewing machine as defined in claim 3, wherein said cover plate is longer than said opening of said box in said one of said first and second directions.

7. The embroidery sewing machine as defined in claim 6, wherein said box has a means for housing said cover plate in said box.

8. The embroidery sewing machine as defined in claim 3, wherein said cover plate is moved along an inner wall of said box while closing said opening which is formed at said inner wall.

9. The embroidery sewing machine as defined in claim 8, wherein said cover plate is flexible and is movable along said inner wall of said box including a corner.

10. The embroidery sewing machine as defined in claim 8, wherein said box has guide members provided on said inner wall thereof for guiding said cover plate.

11. A drive device including an embroidering frame for holding a work to be stitched, a first drive mechanism operated in synchronism with vertical reciprocation of a needle to move the embroidering frame in a first direction and a second drive mechanism operated in synchronism with vertical reciprocation of the needle to move the embroidering frame in a second direction normal to the first direction, said drive device comprising:

a means for holding said embroidering frame, the holding means being connected to one of said first and second drive mechanisms to be moved thereby as it is protruded out of a box which is provided to house said drive device therein, said box having a cover means provided therewith for closing an opening formed thereat through which said holding means is moved for embroidery stitching operation.

12. A drive device including an embroidering frame for holding a work to be stitched, a first drive mechanism operated in synchronism with vertical reciprocation of a needle to move the embroidering frame in a first direction and a second drive mechanism operated in synchronism with vertical reciprocation of the needle to move the embroidering frame in a second direction normal to the first direction, said drive device comprising a means for holding said embroidering frame, the holding means being connected to one of said first and second drive mechanisms to be moved thereby as it is protruded out of a box which is provided to house said drive device therein, said box having a cover means provided therewith for closing an opening formed thereat through which said holding means is moved for embroidery stitching operation, said cover means being moved in association with movement of said holding means in one of said first and second directions while closing said opening.

13. The drive device as defined in claim 12, wherein said cover means includes a cover plate for closing said opening of said box, said cover plate having a second opening formed thereat for allowing said holding means to protrude out of said box.

* * * * *

UNITED STATES PATENT AND TRADEMARK OFFICE

CERTIFICATE OF CORRECTION

PATENT NO. : 6,715,434 B2
DATED : April 6, 2004
INVENTOR(S) : Ninomiya

It is certified that error appears in the above-identified patent and that said Letters Patent is hereby corrected as shown below:

Title page,
Item [*] Notice, delete the phrase "by 199" and insert -- by 253 days --

Signed and Sealed this

Fifth Day of April, 2005

JON W. DUDAS
*Director of the United States Patent and Trademark Office*